US005536377A

United States Patent [19]

Hiermaier et al.

[11] Patent Number: 5,536,377

[45] Date of Patent: Jul. 16, 1996

[54] GALVANIZING MAGAZINE FOR COATING WORK PIECES

[75] Inventors: Manfred Hiermaier, Groebenzell; Paul Buenger, Munich; Willi Buchecker, Tittling, all of Germany

[73] Assignees: MTU Motoren- und Turbinen- Union, Munich; BL Produktions GmbH, Tittling, both of Germany

[21] Appl. No.: 480,895

[22] Filed: Jun. 7, 1995

[30] Foreign Application Priority Data

Jun. 8, 1994 [DE] Germany ..... 44 19 984.8

[51] Int. Cl.[6] ..... C25D 17/08

[52] U.S. Cl. ..... 204/199; 204/297 W; 204/297 M; 204/297 R

[58] Field of Search ..... 204/199, 200, 204/201, 212–213, 297 R, 297 W, 297 M

[56] References Cited

U.S. PATENT DOCUMENTS

| | | | |
|---|---|---|---|
| 2,911,347 | 11/1959 | Gutzmer | 204/297 M |
| 4,194,957 | 3/1980 | Lipschutz | 204/199 |
| 4,497,693 | 2/1985 | Ogura et al. | 204/297 W X |
| 4,734,179 | 3/1988 | Trammel | 204/199 |

FOREIGN PATENT DOCUMENTS

| | | |
|---|---|---|
| 520334 | 3/1931 | Germany . |
| 2228316 | 1/1973 | Germany . |
| 2537362 | 3/1977 | Germany . |
| 61-227198 | 10/1986 | Japan . |
| 1-4499 | 1/1989 | Japan . |
| 3-100200 | 4/1991 | Japan . |
| 1372208 | 10/1974 | United Kingdom . |

*Primary Examiner*—Donald R. Valentine
*Attorney, Agent, or Firm*—W. G. Fasse; W. F. Fasse

[57] ABSTRACT

A galvanizing magazine has electrically conducting electrodes for holding a multitude of small parts in positions that assure uniform coating conditions for all parts held in any of electrodes held in the magazine. A hollow cylindrical electrode with slots therein forms the magazine, or a plurality of rod electrodes held in a current distributing disk at one end and in a mounting disk at the other end form the magazine. The electrodes have receptacles so that each receptacle holds one small part in such a way that the longitudinal axis of the small part and the central axis of the receptacle extend at a right angle and radially to a rotational axis of the magazine. The receptacles are uniformly spaced from each other in a row along a respective electrode and also uniformly spaced with angular spacings in the circumferential direction around the longitudinal rotational axis of the magazine. Thus, the part surfaces to be plated face radially outwardly while the part itself is held in a fixed position with an electrical contact between the part and the electrode. This construction assures a consistently reproducible and controllable coating quality, even for large numbers of small parts. Such a magazine is easily loaded and unloaded in an automatic manner.

19 Claims, 1 Drawing Sheet

GALVANIZING MAGAZINE FOR COATING WORK PIECES

CROSS-REFERENCE TO RELATED APPLICATION

The disclosure of the present application is related to our commonly assigned application U.S. Ser. No. 08/480,896 filed on Jun. 7, 1995 and entitled: "HOLDING AND CONTACTING APPARATUS FOR GALVANICALLY COATING WORK PIECES".

FIELD OF THE INVENTION

The invention relates to a magazine or carrier for coating or plating work pieces such as small parts in a galvanizing operation. The terms galvanizing, coating, and plating are used as synonyms herein.

BACKGROUND INFORMATION

The coating of work pieces such as small parts by a galvanic or plating operation is well known for the purpose of applying protective coatings to the surfaces of components including large components and small parts for improving the material characteristics of these components and parts. The proper sequence of steps necessary for the coating operation including steps to be performed prior and after the coating itself and the apparatus used for performing these steps are very important for the efficiency and economy of such coating operations. In the coating of small parts produced by mass production procedures it is customary to use a drum type galvanizing apparatus, whereby the small parts are filled into the drum in the manner of bulk material. The drum is conventionally provided with a horizontal axis about which the drum is rotated in a galvanizing bath. The just described conventional method permits an efficient surface coating of large numbers of parts, especially small parts.

However, the use of a drum that rotates in a galvanizing bath or is filled with a galvanizing bath is not very suitable in those instances, where a high coating quality is required, because the proportion of components having a high quality coating relative to the total number of parts in a batch is relatively small, whereby the number of rejects is correspondingly high, because the electrical contact of the parts with the drum that forms an electrode in the galvanic bath remains undefined due to the bulk material nature of the small parts. As a result, the coating thickness is not uniform over the entire surface of each part. Similarly, the quality of the coating is not uniform from part to part and even on different surface portions of the same part. Conventional methods and devices also leave room for improvement with regard to coating only a defined surface area of a part and leaving the remaining surface area uncoated.

OBJECTS OF THE INVENTION

In view of the above it is the aim of the invention to achieve the following objects singly or in combination:

to provide a carrier capable of holding a multitude of small parts in a defined position for assuring a high quality coating to be performed in an efficient coating operation;

to assure that at least one critical surface area of a component or part is uniformly coated with a high quality coating in a galvanizing operation while leaving other surface areas uncoated;

to make sure that the coating quality is consistently repeatable and controllable even for large numbers of parts, especially small parts;

to construct a parts carrier or magazine, especially for small parts, which can be efficiently loaded and unloaded; and to construct the carrier or magazine in such a way that it is efficiently usable for any preliminary and subsequent operations or treatments necessary as part of a galvanizing or coating operation, such as rinsing, drying, etc.

SUMMARY OF THE INVENTION

The magazine according to the invention is characterized by a plurality of electrodes, each electrode comprising receptacles uniformly spaced from each other along the respective electrode for holding parts with an electrical contact between parts and the respective electrode, said receptacles holding each part so that a part surface to be galvanized or coated faces outwardly, a mounting shaft preferably centrally positioned, having a first end and a second end, a mounting disk secured to said first end of said mounting shaft, said mounting disk having sockets in which ends of said electrodes are held with a plug-in connection, and an electrically conducting current distributing disk connected to said second end of said mounting shaft, and connectors electrically connecting said electrodes to said current distributing disk.

Preferably, each part is held according to the invention, so that its surface area to be galvanically coated is facing radially outwardly from the drum-shaped magazine, whereby a longitudinal axis of the respective part extends radially to the longitudinal rotational axis of the magazine.

The plurality of electrode rods are held together at one end by the electrically conducting current distributing disk and at the other end by the mounting disk that may be of insulating or of electrically conducting material. This construction forms the above mentioned drum-shaped magazine which is reinforced by the mounting shaft that centrally interconnects the disks. Receptacles, one for each part, are arranged in at least one row along each rod electrode or in an electrode cover, whereby the row of receptacles extends in parallel to the rotational longitudinal axis of the magazine. The receptacles have preferably one uniform or equilinear spacing from each other along the row of receptacles and another equal angular spacing in the circumference of the drum-shaped cage electrode. The angular spacing is for example 36° from row to row in the circumferential direction.

The present magazine has the following advantages. Due to the regular or uniform or equal spacing of the receptacles for the parts in the axial direction and in the angular circumferential direction, the parts retain at all times a defined spacing to the anode of the galvanizing bath. Such a defined, constant spacing provides a consistently reproducible and controllable coating quality of the parts, even if large numbers of parts are being coated. Another advantage is seen in that the defined positions and defined spacings of the parts in their arrangement on the electrode permits an automatic loading and unloading, whereby an individual quality control of the parts can be economically performed. Yet another advantage of the present magazine is seen in that the radially outwardly positioned receptacles for the parts permit performing procedures prior and after the actual galvanizing, while the parts are held in these receptacles. Such procedures involve roughening, rinsing, drying and so forth, whereby expensive resetting of the parts is avoided.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
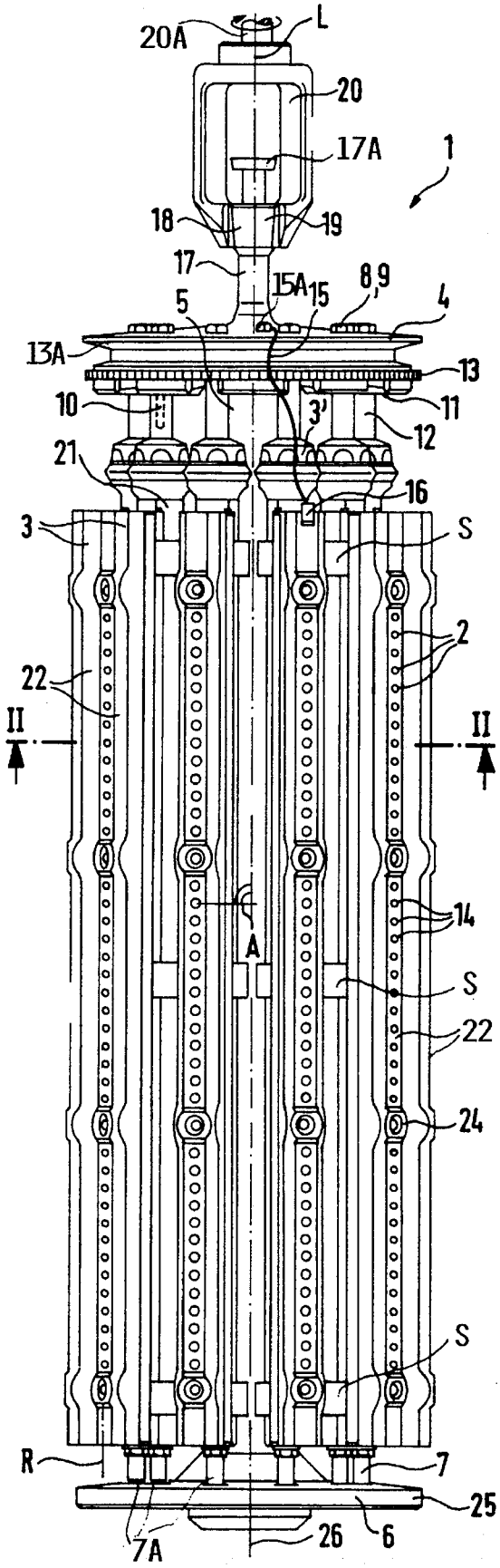
FIG. 1 is a side view of a drum-shaped magazine formed for example of ten electrodes including a coupling device for suspending the magazine, for example in a galvanizing bath.

FIG. 1 shows a magazine or carrier 1 for parts 2 to be galvanized. The term "galvanizing" in this context is intended to cover all surface coating processes, including metal coating, for example chromium plating. The carrier 1 has a longitudinal rotational axis L shown to extend vertically for suspending the carrier 1 in a plating or galvanizing bath, for example for chromium plating small parts 2. The bath itself is not shown.

The carrier 1 comprises at least one electrode, such as a hollow cylindrical electrode or a plurality of electrode rods 3 forming a drum-shaped magazine. A single cylindrical electrode would be slotted to form a drum-shaped cage.

In the shown embodiment, each electrode 3 comprises a rod 21 with an upper end 12 mounted to a current distributor disk 4 of electrically conducting material. In one embodiment the disk 4 is provided with holes into which the upper ends 12 are inserted and held in place by screws 8 having threadings 9 extending into female threadings 10 inside the rod ends 12. Preferably, the rod ends 12 have a rectangular or square cross-section so that the rods cannot rotate relative to the disk 4. The electrodes 3, including their support rods 21 and the end disk 4 are made of electrically conducting material such as copper.

A support or mounting shaft 5 is preferably centrally located and made of electrically non-conducting material, such as an insulating synthetic material, extends longitudinally and preferably coaxially to the rotational axis L. The upper end of the shaft 5 is connected to the electrical current distributor disk 4. The lower end of the shaft 5 is connected to a mounting disk 6 having axially facing sockets 7A therein, in which the lower foot ends 7 of the electrode rods 21 are received with a plug-in connection providing a location fit. Thus, for example 10 electrodes 3 with their support rods 21 are arranged between the distributor disk 4 and the mounting disk 6, with equal on-center circumferential spacings of 36°. Instead of the plug-in connection, a screwed connection may be used as described above with reference to the upper ends 12 connected to the disk 4, for securing the lower ends of the electrodes to the mounting disk 6. The rigid connection of the rod electrodes 3, 21 to the current distributor disk 4 at the upper end, and to the mounting disk 6 at the lower end in combination with the reinforcing central shaft 5 results in a sturdy construction.

In order to minimize the electrical transition resistance in the screw connections 8, 9 and 10 between the current distributor disk 4 and the electrodes 3, it is preferable, that the threadings 9 of the screws 8 and the female threadings 10 in the ends 12 of the electrode support rods 21 are plated with a good conductor such as gold or silver.

Instead of the above mentioned holes for receiving the ends 12 of the electrode support rods 21, the disk 4 may be provided with radially extending grooves 11 angularly spaced from each other, for example by 36° for accommodating ten rods 21 carrying ten electrodes 3. The radially extending grooves 11 are radially outwardly open to receive the upper ends 12 of the electrode rods 21 in which the inner threadings 10 extend axially. Since the grooves 11 are open radially outwardly, upon releasing the screw connections 8, each electrode 3 may be tilted about its foot 7 for moving the end portions 12 radially out of the grooves 11, to thereby remove the electrodes from the magazine. This feature of the invention greatly facilitates the loading and unloading of the parts 2 into the receptacles 14 provided in each individual electrode 3. When the individual electrodes are assembled back into the cage formation, care is to be taken, that each electrode 3 is tightly screwed into contact with the current distributing disk 4 by tightening the screw connections 8.

Transition resistances can be further reduced by an electrical shunting conductor 15 electrically connected at 15A to the conducting disk 4 and soldered to a tab 16 of each electrode 3. Ten such conductors may be used, one for each electrode. These shunting conductors 15 assure a proper current distribution, even if the screw connections 8 should fail to provide proper electrical connections. The conductors 15 reduce transition resistances.

The drive for rotating the cage electrode 1 in a plating bath may for example be provided by a gear drive, not shown, but meshing with a gear rim 13 forming part of the disk 4. Additionally or instead the disk 4 may be provided with a V-belt pulley groove 13A as shown in FIG. 1. Further, by rotating the cage electrode about the longitudinal axis L, it is now possible to bring each individual electrode 3 of the cage electrode 1 into a precise loading or unloading position in which the receptacles 14, for holding parts 2 in a fixed position, face a loading or unloading apparatus not shown. Another advantage of the rotatability of the cage electrode 1 is seen in that it is useful for rinsing, drying and even during the coating operation itself, for agitating the galvanizing or coating bath.

Referring to the upper portion of FIG. 1, a central shaft stub 17 of electrically conducting material is rigidly connected to the disk 4 coaxially to the rotational axis L. Thus, the disk 4 is positioned between the electrode ends 12 and the shaft 17. The shaft 17 has a free end 18 forming a conical surface having a large diameter away from the disk 4 and a smaller diameter closer to the disk 4. The conical end 18 cooperates with a snap-in claw 19 of a suspension bracket 20. The suspension bracket 20 forms part of a galvanizing apparatus not shown in further detail. Preferably, the bracket 20 has a concentric shaft 20A rotatable about the longitudinal axis L of the electrode cage 1, so that rotation may be imparted to the magazine 1 instead of applying a driving force to the disk 4. The claw 19 of the bracket 20 can sufficiently yield in an elastic manner to insert the conical end 18 into the claw 19, which then provides a location-fit to properly hold the magazine 1 suspended in a bath, for example. The shaft 17 has an extension 17A that is accessible in the bracket 20, which is laterally open, so that a tool may be inserted for levering the magazine 1 out of the grip of the claw 19. The claw 19 performs not only the just described holding function but also serves as an electrical conductor. For this purpose a slide contact may cooperate with the bracket 20, for example at its upper round end. The contact between the conical end 18 of the shaft 17 with the claw 19 provides a large surface area contact which assures a small transition resistance to the flow of the galvanizing current.

Figure 2:
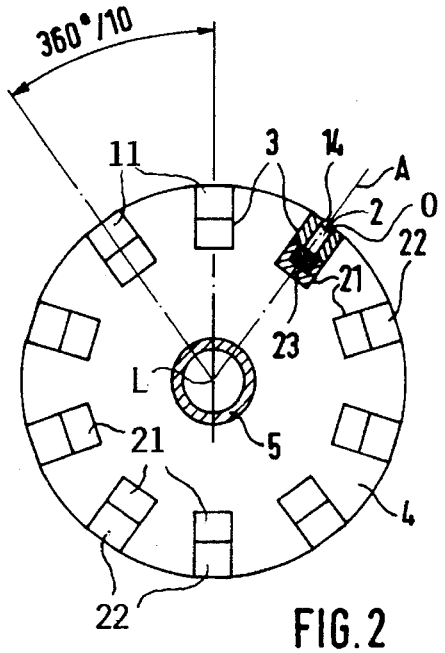
FIG. 2 is a sectional view along section line II—II in FIG. 1.

Referring to FIGS. 1 and 2 in conjunction, each electrode 3 comprises substantially the above mentioned electrode support rod 21 and a cover 22 supported by the electrode rod 21. The covers 22 are provided with receptacles 14 arranged in a row R with uniform or equal spacings from one another along the length of the respective row R and with a different angular spacing circumferentially around the magazine. As mentioned, and as shown in FIG. 2, the angular on-center spacing between neighboring electrodes 3 will be 36° if ten electrodes 3 are used. The receptacles 14 may be simple bores, if the parts 2 are cylindrical parts having a surface O to be galvanized. Preferably, the cylindrical small parts 2 are held in the receptacles 14 of the cover 22 by at least one magnetic device such as a permanent magnet 23 held in place below a shoulder formed by the inner surface of the cover 22. The cover 22 and the permanent magnets 23 inserted into the electrode support rods 21 provide a good electrical contact between the parts 2 and the electrodes 3.

The rows R of receptacles 14 extend in parallel to the longitudinal rotational axis L of the magazine 1. This arrangement of the receptacles 14, so that the receptacle axis extends radially to the longitudinal axis L facilitates the accessibility for the automatic loading and unloading of the small parts 2 into the receptacles 14 and out of the receptacles 14. Due to the uniform spacing in the axial and circumferential direction as mentioned above, negative or adverse influences on the electrical current distribution and disturbances of a magnetic nature are prevented.

The spacers S, shown in FIG. 1, make sure that the electrode sections 3 with their support rods 21 maintain the proper angular spacing all along the length of the electrodes 3. The just described features assure a uniform coating as to quality and thickness of the small parts 2 independently of any location of any particular part within the magazine 1. As mentioned, the longitudinal axis A of the bores forming the receptacles 14 extends substantially perpendicularly and radially to the longitudinal axis L. This feature also contributes to a consistently reproducible coating of high quality in addition to the above mentioned automatic loading and unloading. The holes 24 help in properly aligning the respective electrode with a loading or unloading apparatus not shown, but provided with centering pins that engage into the holes 24 for proper alignment of the receptacles 14 with the loader or unloader.

To assure a long operational life of the entire magazine 1, it is preferred to make the central shaft 5 and the mounting disk 6 of a synthetic material that is resistant to chemical attack. Similarly, the rods 21, that support the electrode section 3, should be coated with a corrosion protecting layer. The cover 22 should be made of an electrochemically resistant synthetic material.

The mounting disk 6 is preferably provided with a centering hole 26 extending coaxially to the axis L. This hole 26 cooperates with a respective pin in the wall of the galvanizing bath, so that the entire magazine 1 may be held for concentric rotation about the axis L. Such concentric rotation is further facilitated by providing the mounting disk 6 with a circumferentially running surface 25 also concentric to the axis L. The running surface 25 cooperates with a respective support surface in the wall of the bath container or it helps inserting the magazine into a holder of the loader or unloader or of a magazine conveyor not shown.

Although the invention has been described with reference to specific example embodiments, it will be appreciated that it is intended to cover all modifications and equivalents within the scope of the appended claims.

What is claimed is:

1. A magazine having a longitudinal central axis (L) for holding parts (2) to be galvanized or plated, comprising a plurality of electrodes (3), each electrode comprising receptacles (14) uniformly spaced from each other along the respective electrode (3) for holding parts (2) with an electrical contact between parts and the respective electrode, at least one magnet (23) for holding said parts (2) in said receptacles (14) so that a part surface to be galvanized or coated faces outwardly from the respective receptacle, a mounting shaft (5) having a first end and a second end, a mounting device (6) secured to said first end of said mounting shaft ( 5 ), said mounting device (6) having sockets (7A) in which said electrodes (3) are held, and an electrically conducting current distributing device (4) connected to said second end of said mounting shaft (5), and releasable connectors (8, 9, 10) electrically connecting said electrodes (3) to said current distributing device (4).

2. The magazine of claim 1, wherein said connectors (8, 9, 10) electrically connecting said electrodes (3) to said current distributing disk (4) are screw connectors.

3. The magazine of claim 2, wherein said screw connectors comprise threadings (9, 10) having an electrical conduction enhancing metal coating on said threadings.

4. The magazine of claim 1, further comprising electrically conducting bridging conductors (15) having one end electrically connected to said current distributing device (4) and the other end electrically connected to the respective electrode (3) for electrically bridging said releasable connectors (8, 9, 10) between said current distributing device (4) and said electrodes (3).

5. The magazine of claim 1, further comprising a drive element (13, 13A, 17, 20A) for rotating said magazine about said longitudinal central axis (L).

6. The magazine of claim 5, wherein said current distributing device comprises a current distributing disk (4), and wherein said drive element comprises a gear rim (13) as part of said current distributing disk (4).

7. The magazine of claim 5, wherein said current distributing device comprises a current distributing disk (4), and wherein said drive element comprises a pulley (13A) as part of said current distributing disk (4).

8. The magazine of claim 1, further comprising an electrically conducting central axle stub (17) electrically and mechanically connected to said current distributing device (4) coaxially with said current distributing device (4) for connection to a galvanizing current supply.

9. The magazine of claim 8, wherein said central axle stub has an electrical contact surface (18) that widens conically away from said current distributing device (4) to an end portion of said central axle stub for suspending said magazine and for a current supply through said electrical contact surface.

10. The magazine of claim 1, wherein said mounting device (6) comprises a circumferential running surface (25) for mounting said magazine in a loading device, an unloading device, or a magazine conveyor.

11. The magazine of claim 1, wherein said mounting shaft (5) and/or said mounting device (6) are made of chemically resistant, electrically insulating material.

12. The magazine of claim 1, further comprising ring sector spacers (S) uniformly spacing said electrodes (3) circumferentially around said longitudinal central axis (L).

13. The magazine of claim 1, further comprising positioning elements (24) for docking said electrodes (3) to a loading or unloading device.

14. The magazine of claim 1, wherein each electrode (3) comprises one or several permanent magnets (23) for holding one of said parts (2) in each receptacle (14).

15. The magazine of claim 1, wherein said current distributing device (4) has radially extending slots (11) which are open radially outwardly, said electrodes (3) having ends (12) received in said releasable slots, said connectors holding said electrode ends (12) in place in said slots.

16. The magazine of claim 1, wherein said receptacles (14) comprise bores in said electrodes, said at least one magnet being arranged to hold said parts (2) in said bores for treating an outwardly facing surface of said parts (2).

17. The magazine of claim 16, wherein said bores extend in said electrodes radially relative to said longitudinal central axis (L).

18. The magazine of claim 16, comprising a plurality of permanent magnets (23), one of said permanent magnets (23) being positioned in each of said bores in said electrodes.

19. The magazine of claim 1, wherein said electrodes comprise mounting ends and a plug-in connection between said mounting ends (7) and said sockets (7A) in said mounting device (6).

* * * * *

UNITED STATES PATENT AND TRADEMARK OFFICE

CERTIFICATE OF CORRECTION

PATENT NO. : 5,536,377

DATED : July 16, 1996

INVENTOR(S) : Hiermaier et al.

It is certified that error appears in the above-identified patent and that said Letters Patent is hereby corrected as shown below:

Col. 1, line 8, before "commonly" insert --copending,--.

Col. 7, Claim 15, line 4, delete "releasable", after "said" (second occurrence) insert --releasable--.

Signed and Sealed this

Twelfth Day of November, 1996

*Attest:*

Bruce Lehman

BRUCE LEHMAN

*Attesting Officer*

*Commissioner of Patents and Trademarks*